US010088806B2

(12) United States Patent
Vuille et al.

(10) Patent No.: US 10,088,806 B2
(45) Date of Patent: Oct. 2, 2018

(54) EXTERIOR SUB-ASSEMBLY FOR A TIMEPIECE OR WATCH OR PIECE OF JEWELLERY

(71) Applicant: Omega SA, Biel/Bienne (CH)

(72) Inventors: Pierry Vuille, Les Emibois (CH); Daniel Knuchel, Bienne (CH); Rocco Catanese, Bienne (CH)

(73) Assignee: Omega SA, Biel/Bienne (CH)

( * ) Notice: Subject to any disclaimer, the term of this patent is extended or adjusted under 35 U.S.C. 154(b) by 0 days.

(21) Appl. No.: 15/654,056

(22) Filed: Jul. 19, 2017

(65) Prior Publication Data

US 2018/0032034 A1 Feb. 1, 2018

(30) Foreign Application Priority Data

Jul. 26, 2016 (EP) ..... 16181139

(51) Int. Cl.
*G04B 47/00* (2006.01)
*G04B 45/00* (2006.01)
(Continued)

(52) U.S. Cl.
CPC ..... *G04B 45/00* (2013.01); *A44C 25/00* (2013.01); *G04B 19/283* (2013.01); *G04B 47/04* (2013.01); *G04B 19/00* (2013.01); *G04B 47/00* (2013.01)

(58) Field of Classification Search
CPC ..... G04B 45/00; G04B 19/283; G04B 47/04; G04B 19/00; G04B 47/00; A44C 25/00
See application file for complete search history.

(56) References Cited

U.S. PATENT DOCUMENTS 4,347,594 A * 8/1982 Tschanz ..... G04B 19/223 368/21
5,822,279 A * 10/1998 Cuche ..... G04B 19/283 368/295
(Continued)

FOREIGN PATENT DOCUMENTS

EP 1 431 845 A1 6/2004
EP 1 431 845 B1 6/2004
(Continued)

OTHER PUBLICATIONS

European Search Report dated Feb. 13, 2017 in European Application 16181139.3 filed on Jul. 26, 2016 (with English Translation of Categories of cited documents).

*Primary Examiner* — Sean Kayes
(74) *Attorney, Agent, or Firm* — Oblon, McClelland, Maier & Neustadt, L.L.P.

(57) ABSTRACT

An exterior sub-assembly for a timepiece or watch or piece of jewelry, including a first component and a second component, arranged for a bayonet mount between two rims and two wings comprised in the first component and the second component, and capable of occupying an assembled and indexed position of the first and second components, this sub-assembly including a third ring-shaped component inserted between the first and second components, fixed in rotation with respect to one of these components and including an elastically deformable area, opposing a variable resistance torque to any relative tangential torque between the first and second components, and including a catch cooperating with a relief portion of the component that is not connected to the third component, wherein one particular catch angularly indexes these first and second components.

18 Claims, 6 Drawing Sheets

(51) Int. Cl.

| | |
|---|---|
| ***A44C 25/00*** | (2006.01) |
| ***G04B 19/28*** | (2006.01) |
| ***G04B 47/04*** | (2006.01) |
| *G04B 19/00* | (2006.01) |

(56) References Cited

U.S. PATENT DOCUMENTS

| | | | | |
|---|---|---|---|---|
| 6,599,009 | B2 * | 7/2003 | Terasawa | G04B 19/283 368/294 |
| 9,857,772 | B2 * | 1/2018 | Jufer | G04B 37/1486 |
| 2003/0099165 | A1 * | 5/2003 | Terasawa | G04B 19/283 368/294 |
| 2004/0141424 | A1 | 7/2004 | Hartmann et al. | |
| 2008/0273427 | A1 * | 11/2008 | Zimmermann | G04B 43/00 368/293 |
| 2013/0329537 | A1 | 12/2013 | Erard | |
| 2015/0185702 | A1 | 7/2015 | Silvant | |
| 2016/0041453 | A1 * | 2/2016 | Pizzo | G03B 17/14 396/530 |
| 2016/0098013 | A1 * | 4/2016 | Kadmiri | G04B 19/283 368/273 |
| 2016/0109853 | A1 * | 4/2016 | Kobayashi | G04B 19/286 368/295 |

FOREIGN PATENT DOCUMENTS

| | | | |
|---|---|---|---|
| EP | 1 835 363 | A1 | 9/2007 |
| EP | 1 835 363 | B1 | 9/2007 |
| EP | 2 672 331 | A1 | 12/2013 |
| EP | 2 672 333 | A1 | 12/2013 |

* cited by examiner

EXTERIOR SUB-ASSEMBLY FOR A TIMEPIECE OR WATCH OR PIECE OF JEWELLERY

This application claims priority from European Patent Application No. EP16181139.3 filed on Jul. 26, 2016; the entire disclosure of which is incorporated herein by reference.

FIELD OF THE INVENTION

The invention concerns a sub-assembly, known as an exterior sub-assembly, for a timepiece or for a watch or for a piece of jewelry, comprising a first component including rims projecting from a first skirt alternated with first recesses, and a second component comprising wings projecting from a second skirt alternated with second recesses, arranged to occupy a first disassembled position of insertion, in which said first component and said second component have a first angular orientation with respect to each other, or to occupy an assembled and locked position, in which said first component and said second component have a second angular orientation with respect to each other, different from said first angular orientation, and are held axially by a bayonet mount between at least two said rims and at least two said wings, said sub-assembly comprising at least one third component, which is arranged to be radially or, respectively, axially inserted between said first component and said second component and fixed in rotation with respect to one of the latter, and which includes at least one radially, or respectively, axially elastically deformable area, said deformable area being arranged to provide a resistant torque of variable moment against any relative tangential torque between said first component and said second component.

The invention also concerns a timepiece, particularly a watch, including such an exterior sub-assembly.

The invention also concerns a piece of jewelry including such a sub-assembly.

The invention concerns the field of exterior parts of watches, and the field of jewelry.

BACKGROUND OF THE INVENTION

The exterior parts of watches and similar devices observe numerous constraints, in particular as regards sealing, robustness and appearance, and must be designed to prevent any inadvertent disassembly, inevitably requiring after sales work to change gaskets, perform cleaning, lubrication, or even repair.

Some exterior or control components must also be angularly indexed with respect to each other, to locate original reference, rest or actuation positions, or to facilitate the reading of indications or graduations, or to ensure the continuity of warped surfaces and/or of decorations. This angular indexing is often difficult to achieve successfully in conjunction with properly clamped components and perfectly sealed gaskets.

SUMMARY OF THE INVENTION

The invention proposes to achieve a sealed and secure assembly of exterior components with easily adjustable angular indexing.

To this end, the invention concerns an exterior sub-assembly for a timepiece according to claim 1.

The invention also concerns a timepiece including such an exterior sub-assembly.

The invention also concerns a piece of jewelry including such a sub-assembly.

BRIEF DESCRIPTION OF THE DRAWINGS

Other features and advantages of the invention will appear upon reading the following detailed description, with reference to the annexed drawings, in which:

FIG. 8 with the bayonet in a position at the beginning of insertion, similar to that of FIG. 2.

FIG. 9 after a first relative rotation between the first component and the second component, where a ramp of the latter comes to rest on a deformable area of the third component, before crossing over three catches.

FIG. 10 after a second relative rotation between the first component and the second component, where the ramp has passed over the three catches, and where the first component and the second component are in their indexing position, with the back cover completely closed onto the case middle.

DETAILED DESCRIPTION OF PREFERRED EMBODIMENTS

Figure 1:
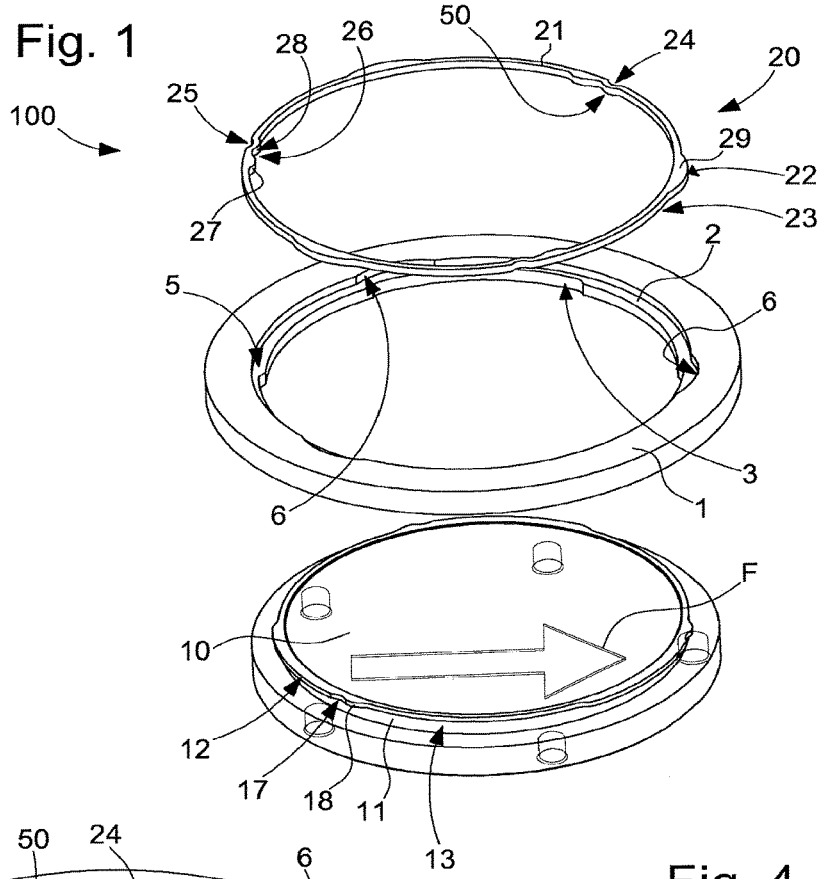
FIG. 1 represents, in a schematic, exploded, perspective view, a particular variant of an exterior sub-assembly according to the invention, including a first component which is a case middle, underneath which is represented a second component which is a case back, including an arrow indicating an angular indexing direction, and provided for the attachment thereof in a bayonet mount to the first component, and a third component which is an elastic ring intended to be inserted between the other two components.
Figure 2:
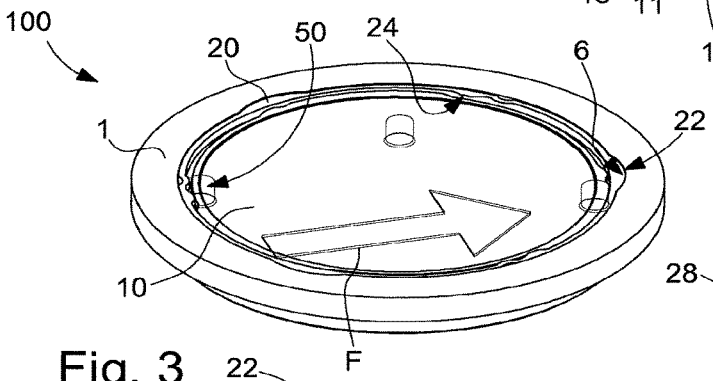
FIG. 2 represents, in a similar manner to FIG. 1, the same sub-assembly after the second component has been inserted to rest on the first component, with the third component mounted angularly integral with the first component, in a first relative angular orientation corresponding to the free passage of the bayonet mount.
Figure 3:
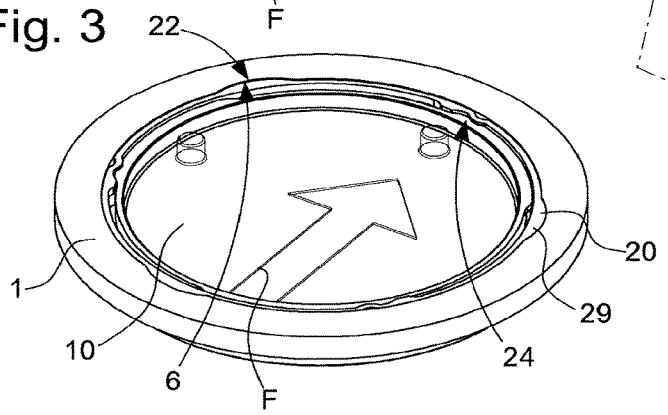
FIG. 3 represents, in a similar manner to FIG. 2, the same sub-assembly in a closed position following closure of the bayonet, after another rotation completed by the perfect relative angular indexing of the second component with respect to the first component, in a second angular orientation.
Figure 4:
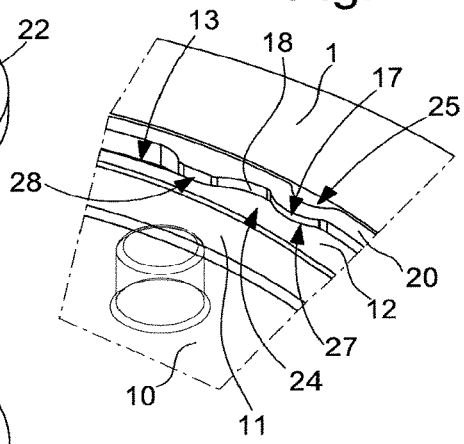
FIG. 4 is a partial perspective view, in the position of FIG. 3, of this exterior sub-assembly, where a relief portion of the second component is resting on a wavy portion of a deformable area of the third component.
Figure 5:
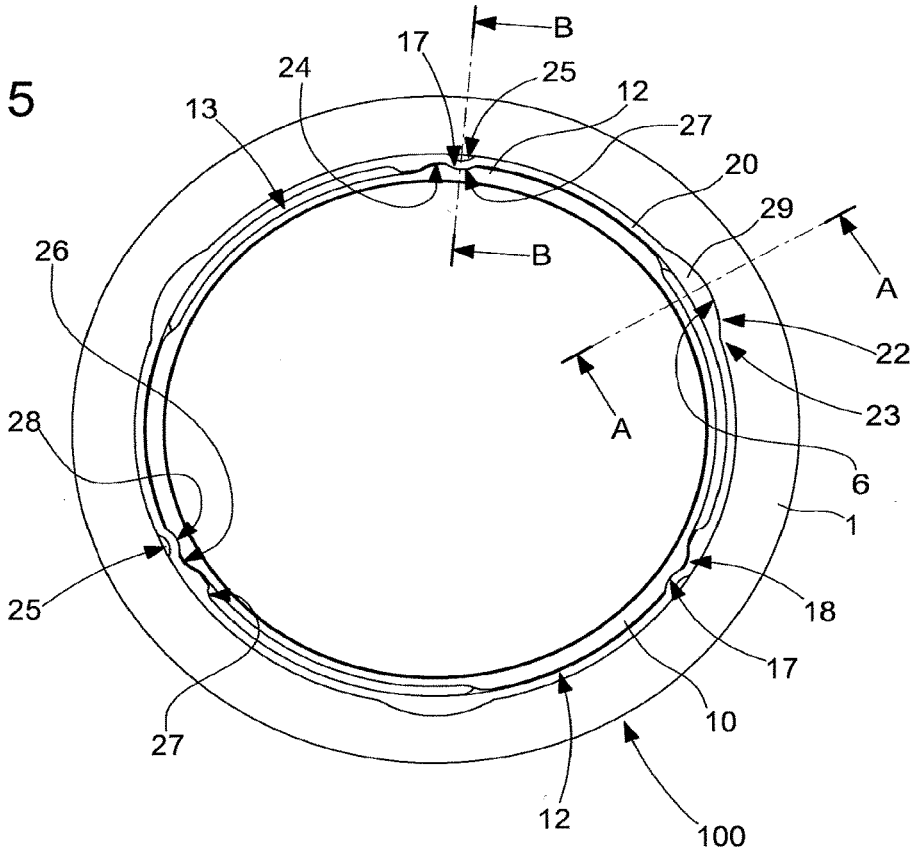
FIG. 5 is a plan view of the same sub-assembly, in the indexed position of FIG. 3.
Figure 6:
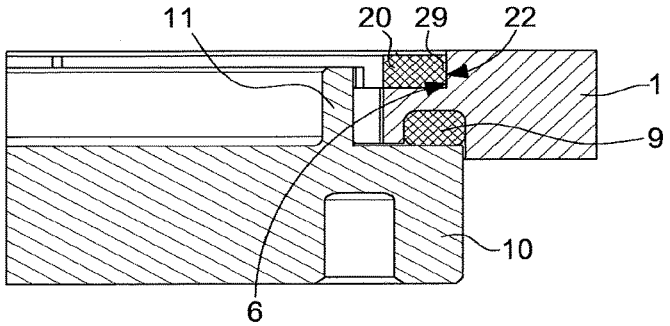
FIG. 6 is a transverse cross-section along the plane AA of FIG. 5.
Figure 7:
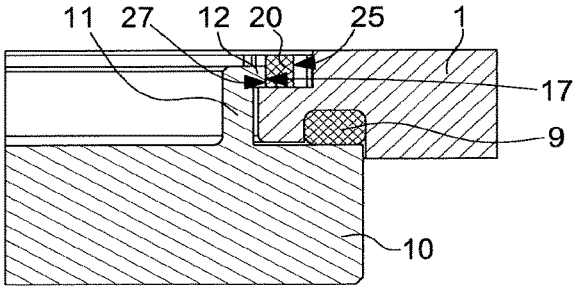
FIG. 7 is a transverse cross-section along the plane BB of FIG. 5.

The invention proposes to achieve a sealed and secure assembly of exterior components with easily adjustable angular indexing, and in a guaranteed position, with a reduced number of components and moderate fabrication costs.

FIGS. 1 to 10 illustrate the non-limiting example of the angular indexing of a case back with respect to a watch case middle.

The invention concerns an exterior sub-assembly 100 for a timepiece, and more particularly for a watch, or for a piece of jewelry, comprising a first component 1 having rims 2 protruding from a first skirt alternated with first recesses, and a second component 10 including wings 12 protruding from a second skirt 11 alternated with second recesses 13.

The general term "exterior" sub-assembly is used here both for a timepiece and for a piece of jewelry, although this term is commonly used only in horology. It is understood, that, in the case of jewelry, this sub-assembly may concern the structure of the piece of jewelry, or elements added to a basic structure, or any assembly of several basic or pre-assembled components, or even the entire piece of jewelry.

This exterior sub-assembly 100 is arranged to pass from a first disassembled position of insertion, to a second, assembled and locked position.

In the first disassembled position of insertion, first component 1 and second component 10 have a first angular orientation with respect to each other.

In a particular, non-limiting variant, comprising repulsion means arranged on the interface between first component 1 and second component 10, these latter tend to be kept at a distance from each other by repulsion means, which include magnetic repulsion means and/or at least one resilient element and/or at least one sealing gasket 9. The change from the first, disassembled position of insertion to the second, assembled and locked position is achieved under the action of forces exerted by an operator: an axial force to overcome the resistance force of the repulsion means and place first component 1 and second component 10 in contact, and a torque to bring them into an angular indexing position.

In the second, assembled and locked position, first component 1 and second component 10 have a second angular orientation with respect to each other, different from the first angular orientation. In the particular variant including repulsion means, first component 1 and second component 10 are held axially against the resistance force exerted by the repulsion means, by means of a bayonet mount, realized by the application of axial and torque forces imparted by the operator, between at least two rims 2 and at least two wings 12.

The joining of first component 1 and second component 10, by a bayonet mount, particularly around an axial direction D, is reversible and allows for disassembly of said components. According to the invention and in a complete departure from the prior art, this disassembly requires, on the part of the operator, similar forces to those exerted during assembly, this disassembly preferably requires the use of a special tool cooperating, for example, with peripheral notches or holes, or similar, and cannot result from mishandling or from exposure to particular external physical factors.

According to the invention, this exterior sub-assembly 100 includes at least one third component 20, which is arranged to be radially or, respectively, axially inserted between first component 1 and second component 10 and fixed in rotation with respect to one of the latter, and which includes at least one radially or, respectively, axially elastically deformable area 50.

This third component 20 is inserted locally, or over extended surfaces, it may take various forms, notably the form of an annular sector or ring, as in the illustrated, non-limiting variant.

This deformable area 50 is arranged to oppose a resistance torque of variable moment against any relative tangential torque between first component 1 and said second component 10. This deformable area 50 includes at least one catch 26, which is arranged to cooperate with at least one complementary relief portion 18 comprised in whichever one of components 1, 10 with respect to which third component 20 is free to rotate. Any passage of a such a catch 26 over a complementary relief portion 18 generates a resistance torque tending to resist the relative rotational movement between first component 1 and second component 10, at least one such catch 26 being arranged for the relative angular indexing between first component 1 and said second component 10.

More particularly, in a particular non-limiting variant comprising repulsion means, and illustrated by the Figures, the invention concerns an exterior sub-assembly 100 for a timepiece or watch, comprising at least one sealing gasket 9 between a first component 1 and a second component 10. In this particular variant, first component 1 includes rims 2 protruding radially inwardly from a first skirt, which are alternated with first recesses 3. Second component 10 includes wings 12 protruding radially outwardly from a second skirt 11, which are alternated with second recesses 13. This exterior sub-assembly 100 is arranged to pass from a disassembled position to an assembled position compressing a sealing gasket 9, by the reversible joining of first component 1 and second component 10, in a bayonet mount between at least two rims 2 and at least two wings 12, in a relative rotational motion about an axial direction D. Although axial compression of sealing gasket 9 is most conventional, the invention also allows for easy assembly with radial compression of such a gasket.

It is understood that the invention is illustrated here in a particular variant, with radially protruding rims and wings. The invention is also applicable to other variants wherein the axial and radial configurations are reversed.

Exterior sub-assembly 100 thus includes at least one third component 20, which is arranged to be radially inserted in the variant illustrated in the Figures, between first component 1 and second component 10. This third component 20 is fixed in rotation with respect to first component 1 or to second component 10. Third component 20 includes at least one area 50 that is elastically deformable, notably radially in the variant of the Figures. This deformable area 50 is arranged to provide a resistance torque of variable moment against any relative tangential torque between first component 1 and second component 10.

This third component 20 has the desired elastic effect, added or inserted inside first component 1 or in second component 10. Preferably, but in a non-limiting manner, it is at least partially annular, in an annular sector, or in the form of a closed ring as in the Figures, or a split ring or similar.

Preferably, deformable area 50 includes at least one catch 26, which is arranged to cooperate with at least one complementary relief portion 18 comprised in whichever one of components 1, 10 with respect to which third component 20 is free to rotate. The relative arrangement of the components of sub-assembly 100 is such that any passage of such a catch 26 over such a complementary relief portion 18 generates a resistance torque, which tends to resist the relative rotational movement between first component 1 and second component 10. At least one such catch 26 is arranged for the relative angular indexing between first component 1 and second component 10. More particularly, the pair formed by one particular catch 26 and one particular complementary relief portion 18 corresponds to the exertion of a maximum resistance force, and this particular pair corresponds to a preferred position for indexing and locking in an indexed position.

More particularly, this third component 20 is a closed, substantially toric ring.

In a particular non-limiting embodiment, third component 20 is made completely of elastic material.

More particularly, first component 1 includes at least one stop housing 6 for an anti-rotational lug 29 comprised in third component 20.

Naturally, the configuration may be reversed, with a stop housing present in the second component 10.

More particularly, deformable area 50 includes a plurality of catches 26, which are arranged to oppose successive resistance to a complementary relief portion 18. More particularly still, in the same deformable area 50, the successive catches 26 are arranged to oppose increasing resistance to a complementary relief portion 18, when the relative angle between first component 1 and second component 10 increases.

It is understood that the resistance force may become greater, the higher the number of catches 26 and of complementary relief portions 18 cooperating with each other. It is thus possible to adjust the number of successive catches and/or the height of each catch, or more precisely, the force resisting the passage of each catch.

During assembly, the user imparts a gradual torque in order to cause the relative rotation between first component 1 and second component 10. After the insertion of second component 10 into first component 1 which locks each gasket 9 in the position of FIG. 2, and after wings 12 and rims 2 are placed in abutment during this relative rotation, the operator assembling sub-assembly 100 encounters a first resistance when a first catch 26 engages with a first complementary relief portion 18. The resistance torque increases during the relative rotation.

In a first case, there is only one first catch 26 and one first complementary relief portion 18 (or each are replaced by a plurality of such pairs, of identical profile and resistance and arranged at the periphery of the profile so as to engage at the same time: which is equivalent to having a single catch and a single relief portion; this possibility of the in-phase duplication of profiles is not explained in more detail, and is applicable to every variant of the invention). In this first case, the minimum axial force applied is necessarily that required to seal the sealing gasket or gaskets 9. In this single cooperation position, first catch 26 and first complementary relief portion 18 form housing 6 and lug 29 for indexing the angular position of second component 10 with respect to first component 1. For example, three catches at 120° cooperate with complementary relief portions also at 120°, the operator only feels one sticking point being passed through when the three catches at 120° act simultaneously.

In a second case, sub-assembly 100 includes several catches 26 and several complementary relief portions 18, arranged relative to one another such that, at the start of relative rotation, only one recess/boss pair are cooperating, then, after a certain angle, two recess/boss pairs are cooperating simultaneously, and so on, with the peak of cumulative resistance torque increasing every time the sticking point is passed, to attain the maximum value at the indexing angle. The operator thus encounters an increasing feeling of resistance.

Sealing exists as soon the bayonet mount is secured, and the mechanism according to the invention is arranged so that, as in the preceding case of a single boss, the sealing gasket or gaskets 9 is/are securely sealed once the first boss has been passed, since thereafter loosening cannot occur without deliberate action by an operator.

In practice, very good results are obtained with at least two, and preferably three, or even four successive bosses, preferably not exceeding five, so as to provide a sufficient basic angular travel for passing over each boss. A good practical example includes three in-phase assemblies each corresponding to three bosses.

Figure 11:
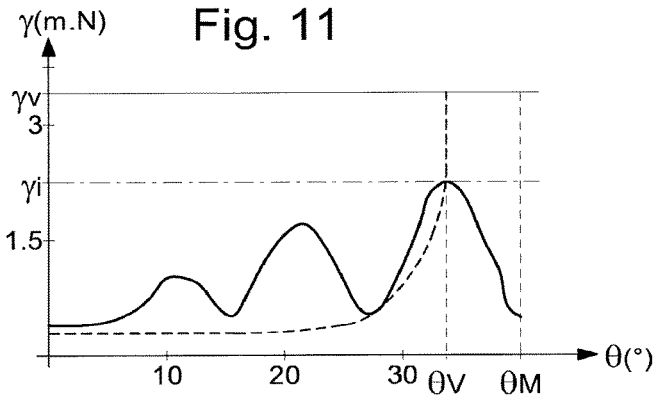
FIG. 11 is an example diagram, for a particular variant of the invention, of the torque consumption on the ordinate, as a function of the relative angle between the first component and the second component on the abscissa, in a bold line for the embodiment of FIGS. 8 to 10, in comparison to an equivalent diagram in a dotted line corresponding to the end of the screw travel of a conventional non-secure closure of a normal screw-in back cover of the prior art.
Figure 12:
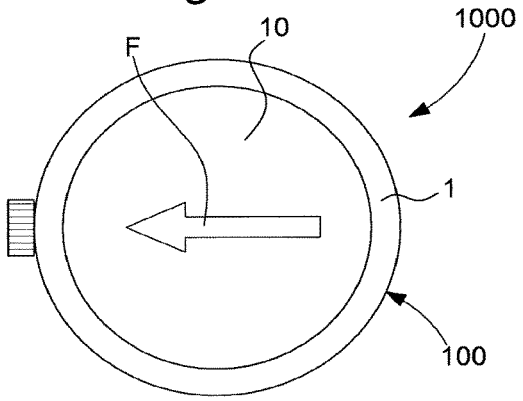
FIG. 12 represents, in a schematic bottom view, a watch comprising such a sub-assembly wherein the case middle forms the first component, and a case back forms the second component.

FIG. 11 illustrates such an example, and superposes the torque profile obtained with a particular variant of the invention, in a solid line, corresponding to the passage over three successive sticking points also called bosses, before immobilisation in the indexing position at angle $\Theta M$, with, by way of comparison to the torque increase in the last degrees of closure of a usual conventional screw-fit of the prior art (which may in particular require an angular amplitude on the order of two revolutions), in a dotted line. In such a conventional screw-fit, the only forces resisting rotation are mechanical friction forces due, in particular, to the axial stresses produced by compressing a sealing gasket at the end of travel, and to the elastic deformation of the components present during the final mechanical locking. It is seen that the level of torque guaranteeing the sealing of gasket or gaskets 9 is only achieved at a much higher relative angle, and that there is no threshold effect on disassembly, since loss of sealing occurs in the event of loosening without encountering a resistant force, contrary to the invention.

Further, the angular value $\Theta V$ corresponding to maximum tightening with a torque $\gamma V$ corresponds to the end of an increasing torque curve, whose slope becomes extremely steep in proximity to this value $\Theta V$: which means that a screw-in sub-assembly which is then subjected to a high stress is liable to work loose, with no safeguard to prevent it becoming completely unscrewed, or loss of sealing, since the torque required to unscrew the sub-assembly wherein case gradually decreases, and the energy needed to unscrew it is lower than in the case of the invention.

In yet another variant, which is not illustrated, the same boss cooperates in succession with several recesses, which may each be of the same depth in a particular embodiment, thereby creating a fixed resistance force value, and which must be passed several times in order to reach the closed and indexed position. It is also possible to combine these last two variants, anything is possible, since the machining operations required are not complex.

Conversely, during assembly, the invention requires several bosses of increasing resistance torque to be passed over in succession, in a kind of ramp, but also on disassembly, since, from the final indexed position ΘM, possibly on a mechanical stop (which is not however necessary within the scope of the invention), any sudden application of force results, in the worst case, in passing over only one boss, without complete disassembly, with a visible shift and especially with no loss of sealing or risk of dirtying the inside of the watch. In the illustrated example, before there is any loss of sealing, the operator must cross through three thresholds in succession, which is optically visible because of the shift.

In a particular case, each catch is identical, and the passage of each catch opposes the same resistance torque.

In an advantageous variant, there are several successive catches and the operator must apply an increasing torque, as in the example of three catches in FIG. 11. The multiplier coefficient of resistance torque, from one catch to another, may be comprised in particular between 1.2 and 2.2.

The invention is advantageous since it is perfectly compatible with the dimensions of horology, while having a capacity for a high resistance force, which may reach several N.m, for example in the case of a third component made of at least partially amorphous metal material. Even with materials more commonly used for fabricating technical rings, POM, polyurethane or suchlike, and axial and radial dimensions of several tenths of a millimeter, the resistance torque easily exceeds one N.m.

Further, in the case where the timepiece or piece of jewelry is subjected to particular large-scale constraints, the disassembly of the mechanism according to the invention requires any force of accidental origin to be maintained over a significant angular travel, of 7 to 8°, to pass over only one boss in the illustrated example, as security remains ensured even if there are several successive bosses, whereas, in the screw-fit solution of the prior art, disassembly, and therefore also loss of sealing, occurs in an angular travel of around only 2°.

In a variant, angular indexing can be guaranteed by an end of travel stop 28. However, preferably, it is third component 20 which, de facto, performs the stop function, by exerting a particularly high resistance torque. Such a mechanical stop is consequently not absolutely necessary.

The invention therefore makes it possible to prevent any untimely and inadvertent disassembly of sub-assembly 100, for example under the effect of vibrations, successive expansion cycles, through misuse by the user, or otherwise.

Preferably, disassembly requires a special tool that is not commercially available, which ensures that maintenance is carried out by service personnel having the requisite qualifications.

The Figures illustrate different non-limiting variant variants.

FIGS. 1 to 7 illustrate a first variant, wherein the third component 20 is a ring 24 held in abutment on a flat surface 5 comprised in rims 2 of first component 1 formed by a case middle, and the extensions of these rims 2. This ring 24 is properly angularly secured to first component 1, by anti-rotational lugs 29 whose external contours are housed in a complementary manner inside housings 6 of case middle 1. The three components present here each include the same contours three times, also arranged at 120°. Second component 10 is a case back, handled by an operator, preferably using a special tool. Above skirt 11 of this case back 10, rim 12 is shaped to be able to gradually deform ring 24 as it rotates (in the anti-clockwise direction in these Figures). This rim 12 includes, in particular, a ramp 18 which causes the opposing surfaces of ring 24 to bend. This ramp is followed here by a recess 17 which permits the movement of protruding catches 27, 28 comprised inside ring 24, one 27 of which is substantially parallel to a recess 25 comprised on the outer surface of ring 24, in such a deformable area 50, whereas the other 28 faces a substantially cylindrical bearing shoulder of ring 24. A hollow 26 separates the protruding catches 27 and 28 on the inner face of ring 24.

Figure 8:
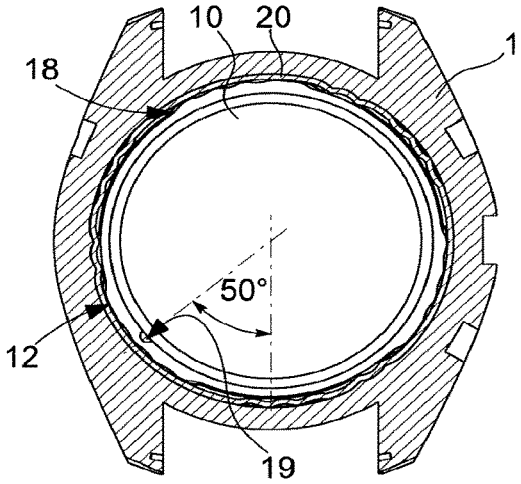
FIGS. 8 to 10 represent plan and top views of another variant of the sub-assembly according to the invention.
Figure 9:
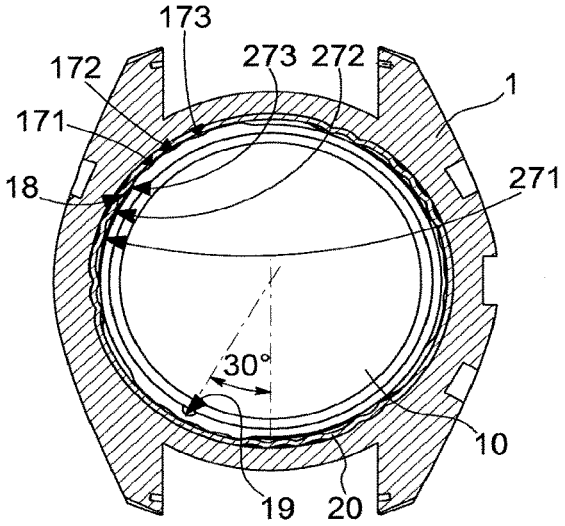
Figure 10:
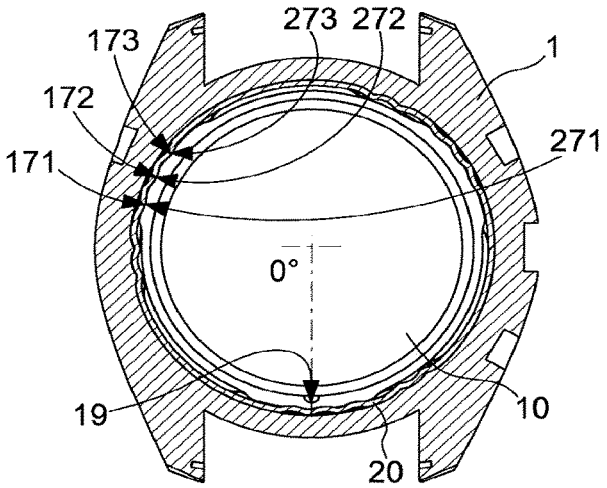

FIGS. 8 to 10 illustrate a second variant, quite similar to the preceding one, also including repetition at 120°, case back 10 includes here, after ramp 18 and separated by intermediate relief portions, three recesses 171, 172, 173, which are arranged to cooperate in succession with bosses 271, 272, 273 of the ring. Angular marking 19 of back cover 10 makes it possible to identify the relative angular position of case middle 1 and case back 10: 50° in FIG. 8, 30° in FIG. 9, 0° in FIG. 10. It is understood that, during the angular progression, first of all a single recess/boss pair 171/273 opposes a first resistance force when the catch that it forms is passed over; then, slightly further on, two recess/boss pairs 171/272 and 172/273 together oppose a second resistance force greater than the first; then, still further on, three recess/boss pairs 171/271, 172/272 and 173/273 together oppose a third resistance force greater than the second. A very simple means is thus obtained for providing an increasing resistance force as a function of the angle of rotation. FIG. 11 clearly shows the passage of each of these catches, and the associated increase in maximum torque level.

The invention is well suited to cases where sub-assembly 100 includes components 1 and 10 made of different materials, with different expansion coefficients, or brittle or hard materials (ceramics, sapphire), which do not allow for standard fastening methods. Conventional configurations that can be cited include the assembly of a gold case middle to a sapphire case back, or a case made entirely of ceramic, a metal-ceramic combination, or suchlike.

Third component 20 is preferably a ring, which may be made of various materials, notable POM, polyurethane, polymer based material, or elastomer, at least partially amorphous metal material; the selected material determines the maximum tightening torque, thus an amorphous metal ring allows for a tightening torque of around 3.2 N.m, similar to the normal torque of a back cover screwed onto a case middle, for a gasket 9 of the same size. This ring may also be made of amorphous metal, stainless steel, CuBe, Liquidmetal©, or be bimaterial, for example with a plastic core with overmoulded metal or ceramic or other inserts. The advantage of such a ring, preferably made of a polymer or similar elastic material, is that it is easy to house inside a volume having very limited free space, in which it is impossible to safely place a metal element capable of breaking.

Naturally, the material of third component 20 may also be more complex, notably in the form of an elastomer type material loaded with technical fibres such as Kevler® or suchlike, or with an anti-wear additive such as polytetrafluoroethylene or PTFE, or other.

In another particular variant, the material of third component 20 is an amorphous alloy. More particularly, the material of third component 20 is $Zr_{58.5}Cu_{15.6}Ni_{12.8}Al_{10.3}Nb_{2.8}$.

An important advantage of the invention is that it does not require drilling or threading, but only simple, easily achievable machining operations, thereby avoiding dirtying or tainting the watch and allowing for a moderate cost.

More particularly, and as seen in FIGS. 1 to 10 and 12, first component 1 is a case middle and second component 10 is a back cover. In a particular variant, the presence of at least one sealing gasket is required. In a non-illustrated variant, first component 1 is a case back and second component 10 is a decorative element, such as a medallion, or similar, added to the case back, in which case there is no need for a gasket between them, and the presence of a spring may be perfectly sufficient in a variant comprising repulsion means.

It is noted, in this regard, that the invention may be implemented without such means of repulsion, particularly for applications for exterior parts or similar.

Figure 13:
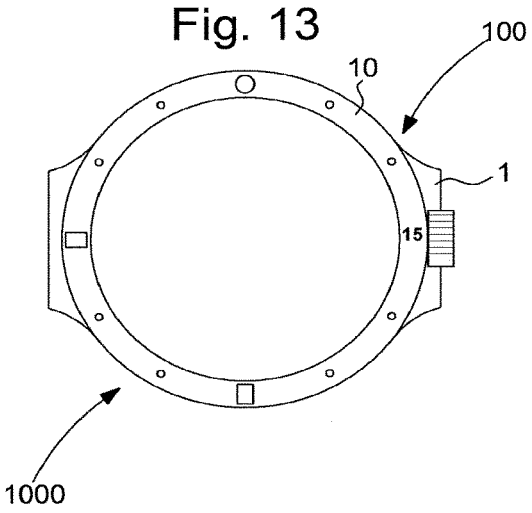
FIG. 13 represents, in a schematic top view, a watch comprising such a sub-assembly wherein a case middle forms the first component, and a bezel forms the second component.

In another application, first component 1 is a case middle and second component 10 is a flange or a bezel, as seen in FIG. 13. This case is well suited to a variant in which a first component and a second component tend to be moved away from each other, by magnetic repulsion, or even by a resilient element such as a ring, i.e. a thin ring, not necessarily closed, or more particularly a ring including segments similar to a ratchet to easily allow only a unidirectional manoeuvre, as in the particular case where the invention is used for a unidirectional bezel. Such a ring may be long and thin, of substantially round cross-section, or of rectangular cross-section, or otherwise. Or, it is simply the actual third component 20 that forms the repulsion means, which substantially reduces the number of components while very satisfactorily ensuring the required hold.

Figure 14:
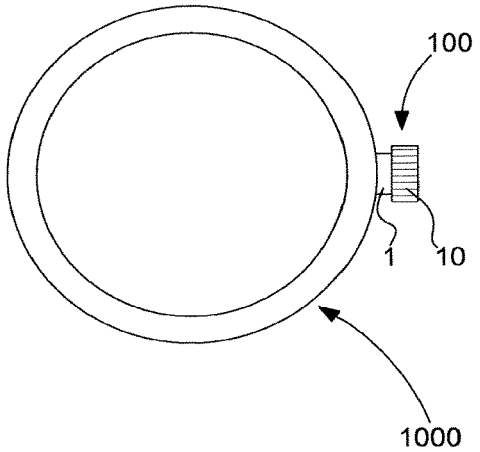
FIG. 14 represents, in a schematic top view, a watch comprising such a sub-assembly wherein a tube secured to a case middle forms the first component, and a crown forms the second component.

In yet another application, first component 1 is a case middle or a tube added to a case middle, and second component 10 is a crown, as seen in FIG. 14. In a variant, second component 10 is a winding stem or a push-piece. In these cases too, the presence of at least one sealing gasket is obligatory.

Figure 15:
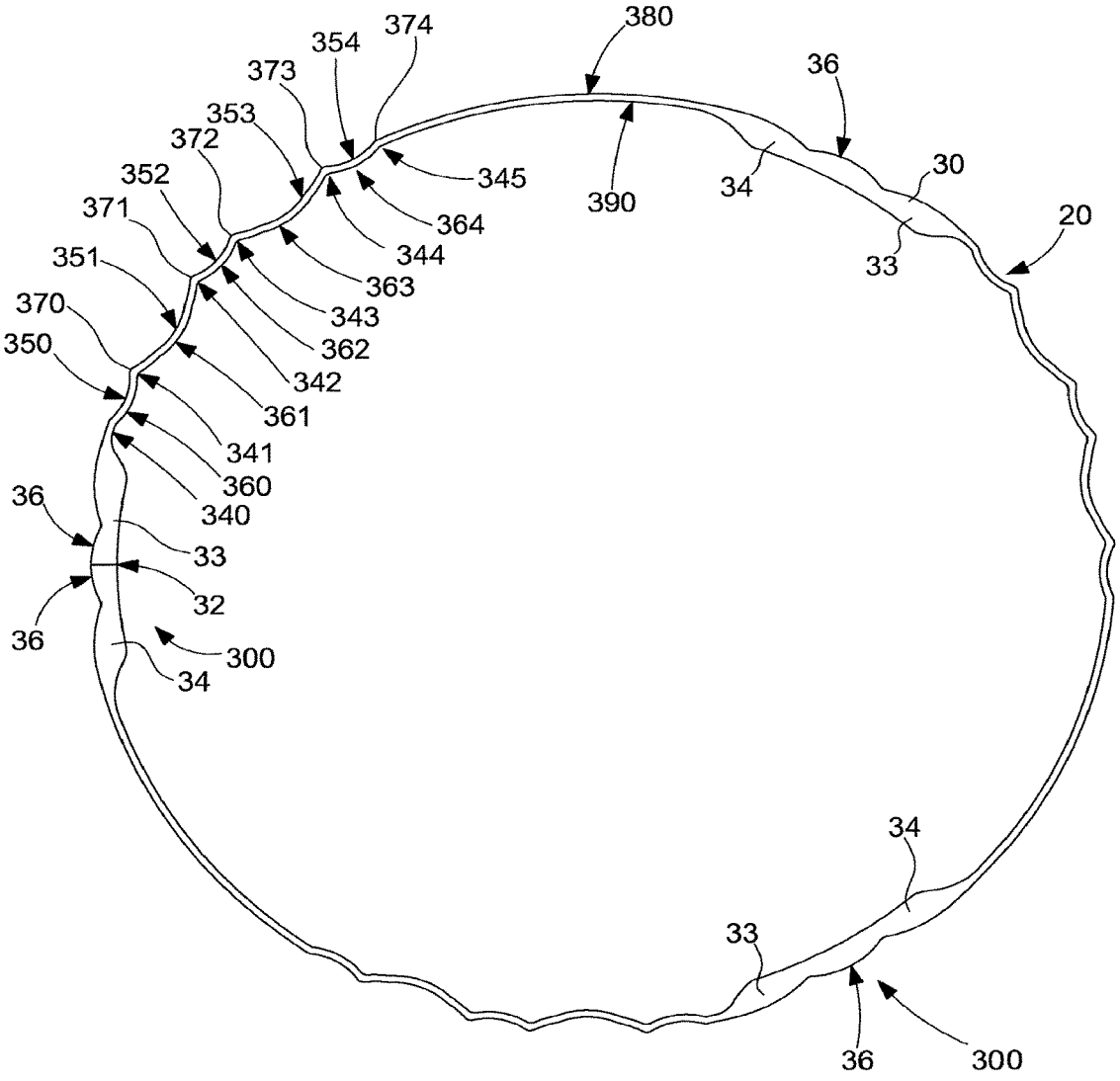
FIG. 15 represents, in a schematic top view, another variant of the third component, in the form of an oriented ring comprising a slot.
Figure 16:
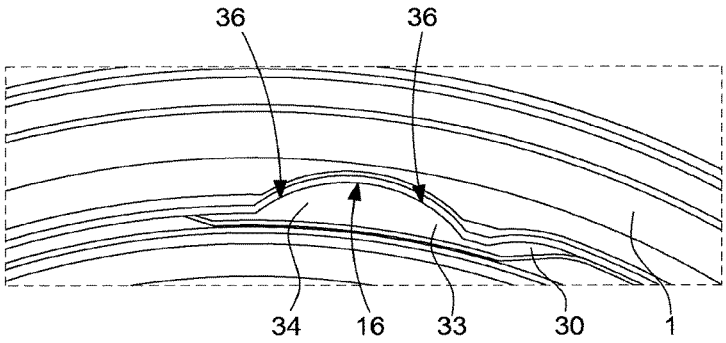
FIG. 16 is an assembly detail of the ring of FIG. 15 with a first component similar to that of the preceding Figures, of complementary profile to this ring.

FIG. 15 represents another variant of third component 20, in the form of an oriented ring 30 comprising a slot 32. On either side of slot 32, bosses 33 and 34 make it possible to grip the ring using a tool; externally, they define together a lug 300 having in particular a radius portion 36 arranged to cooperate in a complementary manner with a recess 16 of first component 1. A first boss 33 is limited by an inner hollow 340, which starts a series of scalloped portions, each defining an inner protruding catch 360 and an outer catch 350, and ending in an edge 370 opposite a hollow 341 for the first scalloped portion, respectively 361/351/371/342 for the second, 362/352/372/343 for the third, 363/353/373/344 for the fourth, 364/354/374/345 for the fifth; this example is non-limiting. The last scalloped portion is followed, externally, by a substantially cylindrical shoulder 380 in an area of substantially constant cross-section of oriented ring 300, and which corresponds with an inner shoulder 390, before reaching a second boss 34 of another lug 300, and so on, oriented ring 30 being represented here with three lugs 300, one of which includes slot 32.

More particularly, except in the areas of bosses 33 and 34 and of lugs 300, the cross-section of oriented ring 30 is substantially constant.

Figure 17:
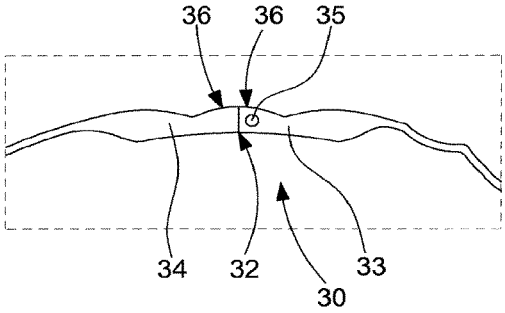
FIGS. 17 to 20 illustrate the slot area of different variants of the oriented ring similar to that of FIG. 15.
Figure 18:
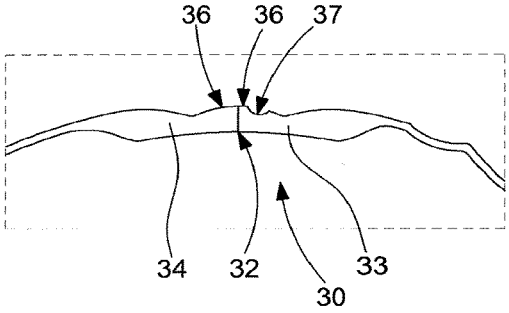
Figure 19:
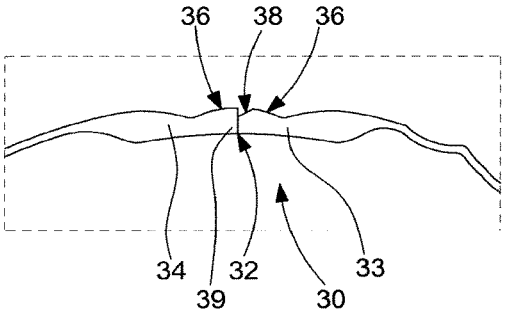
Figure 20:
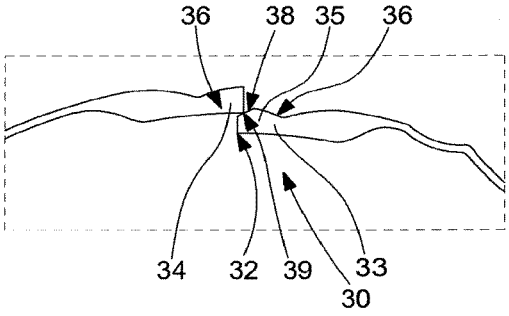

FIGS. 17 to 20 illustrate the slot area of different variants of the oriented ring, devised to facilitate the insertion thereof: FIG. 17 with an orifice 35 for gripping with tweezers or a special tool, particularly of an automated manipulator, or a tip or similar. FIG. 18 with a notch 37 facilitating gripping, FIG. 38 with, on first boss 33, a slope 38 arranged for abutting engagement with a heel 39 of second boss 34, as seen in FIG. 20: the strand including slope 38 is then inserted last. This slope 38 also facilitates disassembly, as in the variants of FIGS. 17 and 18. First component 10 may also be arranged with at least one recess intended to facilitate the insertion of a tool for mounting oriented ring 30.

The invention is suitable for numerous applications in horology, for example for a helium valve in a divers' watch, or for exterior components such as a bracelet or strap, a buckle, a clasp or suchlike. The same applies to jewelry, for effecting closure of cuff links, or of earrings, or for fixing gemstones or decorative elements devised to be removable.

The invention also concerns a timepiece or watch 1000, including such an exterior sub-assembly 100.

The invention also concerns a piece of jewelry including such a sub-assembly 100.

In short, the invention makes it possible to obtain a sub-assembly with a bayonet mount assembly, with a retaining ring mounted on a first component, particularly a substantially toric ring. This ring may also be open, for example with a slot like a circlip or suchlike, to facilitate assembly. During the relative rotation of the second component with respect to the first component, notches of the second component are locked with notches of the ring. This design is compact, it ensures that the sealing of the watch is maintained, and it protects the watch against accidental disassembly.

The invention also ensures the perfect orientation of a component held locked in its service position.

When the sub-assembly according to the invention fulfils a function of closing a case back or similar, it provides numerous advantages

- from a first relative angular position, between the first component and the second component, where the sealing function is ensured, for example as soon as a sealing gasket has been compressed, there exists, in the mechanism according to the invention, an expanded range of relative angular values between this first component and second component, within which sealing remains guaranteed, for example of several tens of degrees, which is important in comparison, for example, to a standard screw-in case back in the case of a case middle/back sub-assembly, where loosening by only a few degrees (less than ten degrees) results in loss of sealing and the need to clean-up, whereas according to the invention, it is only after passing over the very last catch on disassembly that loss of sealing becomes possible if rotation continues;
- closure through a succession of catches which has a closing torque for the large-sized case back, that is both sufficient and acceptable for such an assembly, as a result, in particular, of the multiplication of the number of bosses distributed over the circumference, giving the operator the sensation of screwing-in through steps of increasing closing torque until the desired position, deemed to be the closed position, which is also perceptible;
- opening safety, which is increased by two factors: the need for the operator to provide significant positive energy to pass a catch; and the passage of several catches in succession prior to any loss of sealing.

The invention also makes it possible for opposing components made of different types of materials to cooperate with each other, without expansion, friction, elasticity or other stresses, without requiring external securing elements such as screws or suchlike, without screw threads or machining likely to weaken particular materials, such as ceramics, sapphire and suchlike. It exhibits very good resistance to accidental or even deliberate loosening by vibration or of the Chapuis shock type test. The invention also ensures the interchangeability of components and consequently, improved customisation of watches or jewelry for users.

This invention can be applied equally to watches or jewelry made of precious materials and to mass produced products including components with a low unit cost, particularly made of plastic or similar material.

The invention is well suited to cases where sub-assembly 100 includes components 1 and 10 made of different materials, with different expansion coefficients, or brittle or hard materials (ceramics, sapphire, precious stones, gems, cameos), which do not allow for standard fastening methods. Conventional configurations that can be cited include the assembly of a gold case middle to a sapphire case back, or a case made entirely of ceramic, a metal-ceramic combination, or suchlike. Components 1 and 10 may thus be made in all sorts of materials: metal alloys, especially precious or graded alloys, stainless steels, at least partially amorphous metal alloys, or Liquidmetal©, or similar, ceramics, sapphire, minerals, hard stones, rubber, plastic materials and particularly thermoplastic elastomer known as TPE, especially thermoplastic polyurethane known as TPU, polycarbonate known as PC, polyvinyl chloride known as PVC, polyacetal or polyoxymethylene known as POM, silicone, Nylon®, to mention, in a non-limiting manner, only materials used in horology and jewelry.

What is claimed is:

1. An exterior sub-assembly for a timepiece, or for a watch, comprising a first component having rims protruding from a first skirt alternated with first recesses, and a second component comprising wings protruding from a second skirt alternated with second recesses, arranged to occupy a first disassembled position of insertion wherein said first component and said second component have a first angular orientation with respect to each other, or to occupy a second, assembled and locked position wherein said first component and said second component have a second angular orientation with respect to each other, different from said first angular orientation, and are held axially in a bayonet mount between at least two said rims and at least two said wings, said sub-assembly comprising at least one third component which is arranged to be radially or, respectively, axially inserted between said first component and said second component and fixed in rotation with respect to one of said components, and comprises at least one radially or, respectively, axially elastically deformable area, said deformable area being arranged to oppose a resistance torque of variable moment to any relative tangential torque between said first component and said second component, wherein said deformable area comprising at least one catch arranged to cooperate with at least one complementary relief portion comprised in whichever one of the components with respect to which said third component is free to rotate, and any passage of a said catch over a said complementary relief portion generating a said resistance torque tending to gradually resist the relative rotational movement between said first component and said second component, at least one said catch being arranged for the relative angular indexing in the indexing position between said first component and said second component, and wherein, in said first disassembled position of insertion, said first component and said second component have a first angular orientation with respect to each other, and are held at a distance from one another by repulsion means comprising at least one sealing gasket, and wherein, in said second, assembled and locked position, said first component and said second component are held axially against a resistance force exerted by said repulsion means, and wherein said repulsion means comprise magnetic repulsion means or at least one elastic element.

2. The exterior sub-assembly according to claim 1, wherein said rims protrude radially inwards from said first skirt, said wings protrude radially outwards from said second skirt, wherein said third component is ring-shaped, and arranged to be inserted radially between said first component and said second component.

3. The exterior sub-assembly according to claim 1, wherein said first component comprises at least one stop housing for an anti-rotational lug comprised in said third component.

4. The exterior sub-assembly according to claim 1, wherein said deformable area comprises a plurality of said catches arranged to provide successive resistance against the same said complementary relief portion, and wherein, in the same said deformable area, said successive catches are arranged to provide increasing resistance against the same said complementary relief portion.

5. The exterior sub-assembly according to claim 1, wherein said third component is a ring held in abutment on a plane surface comprised in said rims of said first component wherein said ring is angularly integral, and wherein said rim of said second component is arranged to be able to gradually deform said ring during the rotation thereof, said rim comprising a ramp arranged to bend the opposing surfaces of said ring, which ramp is followed by a plurality of recesses, which are arranged to cooperate in succession with bosses comprised in said ring, and wherein, during the relative rotation between said first component and said second component first of all a single recess/boss pair opposes to said rotation a first resistance force on the passage of the catch that it forms; then, slightly further on, two recess/boss pairs both oppose a second resistance force higher than the first, then, still further on, three recess/boss pairs together oppose a third resistance force higher than the second.

6. The exterior sub-assembly according to claim 1, wherein said third component is in the form of an annular sector or a ring.

7. The exterior sub-assembly according to claim 1, wherein said first component is a case middle or a tube added to a case middle, and said second component is a case back or a flange or a bezel, or a crown or a crown stem or a push-piece when said first component is a case middle or a tube added to a case middle.

8. The exterior sub-assembly according to claim 1, wherein said third component forms said repulsion means.

9. A watch including an exterior sub-assembly according to claim 1.

10. A piece of jewelry comprising an exterior sub-assembly according to claim 1.

11. The exterior sub-assembly for a timepiece, or for a watch, comprising a first component having rims protruding from a first skirt alternated with first recesses, and a second component comprising wings protruding from a second skirt alternated with second recesses, arranged to occupy a first disassembled position of insertion wherein said first component and said second component have a first angular orientation with respect to each other, or to occupy a second, assembled and locked position wherein said first component and said second component have a second angular orientation with respect to each other, different from said first angular orientation, and are held axially in a bayonet mount between at least two said rims and at least two said wings, said sub-assembly comprising at least one third component, which is arranged to be radially or, respectively, axially inserted between said first component and said second component and fixed in rotation with respect to one of the latter, and which comprises at least one radially, or respectively, axially elastically deformable area, said deformable area being arranged to oppose a resistance torque of variable moment to any relative tangential torque between said first component and said second component, wherein said deformable area comprising at least one catch arranged to cooperate with at least one complementary relief portion comprised in whichever one of the components with respect to which said third component is free to rotate, and any passage of a said catch over a said complementary relief portion generating a said resistance torque tending to gradually resist the relative rotational movement between said first component and said second component, at least one said catch being arranged for the relative angular indexing in the indexing position between said first component and said second component, wherein said third component is a ring held in abutment on a plane surface comprised in said rims of said first component wherein said ring is angularly integral, and wherein said rim of said second component is arranged to be able to gradually deform said ring during the rotation thereof, said rim comprising a ramp arranged to bend the opposing surfaces of said ring, which ramp is followed by a recess which permits the movement of protruding catches comprised inside said ring on a said deformable area, and wherein said repulsion means comprise magnetic repulsion means or at least one elastic element.

12. The exterior sub-assembly according to claim 11, wherein said rims protrude radially inwards from said first skirt, said wings protrude radially outwards from said second skirt, wherein said third component is ring-shaped, and arranged to be inserted radially between said first component and said second component.

13. The exterior sub-assembly according to claim 11, wherein said first component comprises at least one stop housing for an anti-rotational lug comprised in said third component.

14. The exterior sub-assembly according to claim 11, wherein said deformable area comprises a plurality of said catches arranged to provide successive resistance against the same said complementary relief portion, and wherein, in the same said deformable area, said successive catches are arranged to provide increasing resistance against the same said complementary relief portion.

15. The exterior sub-assembly according to claim 11, wherein said third component is a ring held in abutment on a plane surface comprised in said rims of said first component wherein said ring is angularly integral, and wherein said rim of said second component is arranged to be able to gradually deform said ring during the rotation thereof, said rim comprising a ramp arranged to bend the opposing surfaces of said ring, which ramp is followed by a plurality of recesses, which are arranged to cooperate in succession with bosses comprised in said ring, and wherein, during the relative rotation between said first component and said second component first of all a single recess/boss pair opposes to said rotation a first resistance force on the passage of the catch that it forms; then, slightly further on, two recess/boss pairs both oppose a second resistance force higher than the first, then, still further on, three recess/boss pairs together oppose a third resistance force higher than the second.

16. The exterior sub-assembly according to claim 11, wherein said third component is in the form of an annular sector or a ring.

17. The exterior sub-assembly according to claim 11, wherein said first component is a case middle or a tube added to a case middle, and said second component is a case back or a flange or a bezel, or a crown or a crown stem or a push-piece when said first component is a case middle or a tube added to a case middle.

18. The exterior sub-assembly according to claim 11, wherein said third component forms said repulsion means.

* * * * *